United States Patent [19]

Waggoner

[11] Patent Number: 4,832,289

[45] Date of Patent: May 23, 1989

[54] ANCHORING DEVICE FOR USE IN CREVICES

[76] Inventor: David L. Waggoner, P.O. Box 5353, Durango, Colo. 81302

[21] Appl. No.: 84,984

[22] Filed: Aug. 11, 1987

[51] Int. Cl.[4] ..... A47G 29/00; A63B 29/00

[52] U.S. Cl. ..... 248/231.9; 248/1 R

[58] Field of Search ..... 248/1, 317; 411/344; 182/3, 5; 294/95, 94

[56] References Cited

U.S. PATENT DOCUMENTS

| | | | |
|---|---|---|---|
| 4,184,657 | 1/1980 | Jardine | 248/1 |
| 4,572,464 | 2/1986 | Phillips | 248/1 |
| 4,643,377 | 2/1987 | Christianson | 248/1 |
| 4,643,378 | 2/1987 | Guthrie et al. | 248/1 |
| 4,645,149 | 2/1987 | Lowe | 248/1 |

FOREIGN PATENT DOCUMENTS

| | | | |
|---|---|---|---|
| 2153952 | 8/1985 | United Kingdom | 182/5 |

*Primary Examiner*—Alvin C. Chin-Shue
*Attorney, Agent, or Firm*—Kenton L. Freudenberg; Maxwell C. Freudenberg

[57] ABSTRACT

A climbing device having an anchoring head on the end of a flexible main cable for insertion into a crevice in a rock wall. The head has multiple spring-biased cams which are wedged by a camming action into engagement with the walls of the crevice by pulling on the cable. For placement, the cams are actuated against the spring bias by an elongated flexible sleevelike structure coaxially supported and slidable on the cable. The sleeve structure has at one end a first plate connected by small flexible wire-like members to the cams for operating the cams against their spring bias. The sleeve structure has at its other end a second plate engageable by fingers of the climber to pull the structure along the main cable in the direction away from the cams and against the spring bias, the length of the structure permitting the cams and the first plate to be inserted deeply into the crevice where the first plate cannot be directly manipulated, the cable having a loop engageable by the thumb of the climber to permit one-hand insertion of the device into and release from the crevice by pushing the thumb toward the cams and pulling the sleeve structure by two fingers engaging the second plate. The flexibility of the coaxial main cable and sleeve allow movement of the second plate and the looped portion of the cable without causing movement of the cams from a wedged position.

18 Claims, 3 Drawing Sheets

ANCHORING DEVICE FOR USE IN CREVICES

BACKGROUND OF THE INVENTION

This invention relates to improved climbing devices used for assisting rock climbers in anchoring their climbing ropes at cracks or crevices in rock faces.

Prior art climbing devices of the type described in Jardine U.S. Pat. No. 4,184,657 and Lowe U.S. Pat. No. 4,645,149 incorporate multiple spring biased cams which can be wedged between the opposite walls of a crack or crevice in a rock structure being climbed. The cams are biased to an open position corresponding generally to the maximum spacing between the opposed walls and can be manually retracted to a closed position for convenient insertion into the crack. Upon release of the manual retracting force the cams move toward the open position until they engage the opposite walls. A tug or pull on the climbing device after engagement with the walls causes the cams to tightly wedge against the walls because of the changing radii of the surfaces of the cams which engage the crack walls. The Jardine device, commonly known as the "Friend" climbing device has a sturdy rigid support bar on which all of the components are carried. The end of this bar remote from the cams has an aperture for attachment of a climbing rope. During use of this device it has been well recognized that shifting forces on the rigid support bar cause it and the cams to change position in the crack resulting in a "walk" of the cams to a deeper position in the crack, sometimes to a position where it is difficult or impossible to manipulate the operating bar to release the cams when removal of the device is attempted. Some climbers have even found it necessary to attach an extra cord or other extension to the operating bar to be able to actuate the cams for release when they have progressed too far into the crack.

A climber using a Jardine type of device must often choose between one placement which allows relatively easy access to and manipulation of the operating bar for insertion and removal of the device and another in which the supporting bar does not protrude significantly beyond the rock face. In such a device with a rigid support bar, if the end of the bar to which a rope is attached protrudes beyond the rock face, the force of a fall by the climber may apply a bending force to the bar sufficient to cause the bar to break, thereby rendering the device ineffective as an anchor to protect against such a fall. This problem becomes more acute as the size of the device and the corresponding size of the support bar are decreased.

The device of FIGS. 1 through 4 of the Lowe patent is generally similar to that of Jardine as far as the "walking" problem is concerned. The other embodiments of Lowe in FIGS. 5 through 16 have the cams supported between the ends of a rigid bifurcated member. The other end of this member has extending therefrom a single rod or cable which has a rope receiving loop spaced from the end of the cam supporting member. The rod or cable supports a cam actuator which in its released position abuts the end of the rigid bifurcated member. The cam actuator is directly connected to the cams by small cables and is directly engaged by the fingers of the climber to manually pull it away from the bifurcated member to withdraw the cams against their biasing springs to their retracted positions to allow insertion of the device into a crack. These other embodiments do not provide any significant flexible portion of the device along their axial length between the cams and the manually-engaged cam actuator. Thus the same "walking" problem exists.

The use of a cable for a portion of the support member as described in an alternative embodiment of Lowe may partially overcome the problem of breakage of the Jardine device as described above but does not allow ready access to the cam actuator should the device be inserted or "walk" deeply into a crack.

Other climbing devices which are adjustable and which utilize flexible support cables but which do not utilize camming heads include those described in Guthrie U.S. Pat. No. 4,643,378 and Phillips U.S. Pat. No. 4,572,464. Guthrie and Phillips each disclose embodiments in which the actuating member provides some distance between the operating head and the means of operation by the climber but do not offer the advantage of the present invention. In neither case is a coaxial relationship of support cable and actuating means disclosed. In each case these two elements are side by side. By having separate axes for these two elements the operation of either device depends on the stiffness of the cables to overcome the bending force which results from the application of tension on one element and compression on the other as is necessary for the operation of each device. Furthermore both Guthrie and Phillips have operating heads which are comprised of two relatively movable members and are not symmetrical about the main axis of the device as is the present invention. Even disregarding the inherent disadvantages of actuating means as described in Phillips and Guthrie, neither would lend itself to use in the present invention in which effective operation of the camming head requires application of a force parallel to the main axis of the device to each of the several camming members which are essentially symmetrical about the main axis of the device but which are spaced at varying distances from the axis.

Climbing anchors in use can be subject to significant abrasion by being in contact with the rock surface being climbed and the jostling movement caused by a climbing rope passing through a carabiner attached to the anchor as a climber proceeds up a rock face. An example of a common situation which might tend to cause this sort of abrasion is shown in FIG. 2 in which portions of the present anchoring device are shown hanging over a rock edge. Over time, this abrasive action can cause enough wear to any piece of climbing equipment so as to make it incapable of supporting any significant load, particularly the high load to which it can be subjected when a climber falls while relying on it for protection. The failure of such a device under these circumstances can result in otherwise avoidable serious injury to a climber.

SUMMARY OF THE INVENTION

It is an object of the present invention to provide an improved anchor for use for rock climbing.

Another object of the invention is to provide an improved climbing anchor with an adjustable anchoring head carried by a flexible actuating and supporting body.

Another object of the invention is to provide an adjustable climbing anchor with a flexible body so that the position of the body in relation to the anchoring head has a minimal effect on the security of the placement and movement of the body causes minimal movement of the head.

A further object of the invention is to provide a climbing anchor with an adjustalbe anchoring head carried by a flexible body in which the body can be temporarily stiffened to facilitate placement of the device.

It is another object of the invention to provide a climbing aid in which the main supporting member for the anchoring head is protected against abrasion and cutting.

It is another object of the invention to provide a climbing aid which can be constructed in reduced size for use in very small cracks without increasing the risk of breakage of the device during such use.

Another object of the invention is to enable manual placement of the anchoring head of a climbing device more deeply into a rock wall crevice without interfering with the ease of manual release and removal of the head from the crevice.

Another object of the invention is to provide a climbing devices of various sizes which are color coded to allow quick identification of the range of cracks of intended use of a particular device and without interfering with visual inspection of all components of the devices.

The present invention relates to a multiple-cam device which has a flexible portion of substantial length between the manual actuator for the cams and the cam support to reduce the movement of emplaced cams due to movement of the climbing ropes during climbing and which can be inserted more deeply into a crack for better anchoring and still be easily removed without use of extra tools or ropes.

Because of the distance between the camming head of the device and the manually-engageable operating means, a device according to the teachings of the present invention may be constructed with no practical limitation on the depth of insertion into a crevice and without adversely affecting the ease of retraction of the cams.

In the present invention where the major portion of the main supporting member is constructed of flexible high tensile strength cable the problem of bending or breaking of rigid support bars is overcome due to the ability of the cable to both twist and flex in any direction and orient itself so that any force exerted upon it becomes essentially an axial force which is supported by the full tensile strength of the cable. Climbing devices which use two parallel strands of cable for the primary supporting members share some of the ability of applicant's device to flex but are essentiallyh limited to that flex which occurs in a direction perpendicular to the plane defined by the two supporting cables. As the size of a climbing device becomes smaller so that it may be used in smaller cracks, the use of the rigid support bars becomes impractical because of the risk of an improper placement which could result in breaking the smaller rigid support bar as previously described. Thus the use of a flexible cable supporting member in the present invention allows construction of a device in which the placement of the device is far less critical than with previous devices and in which dependable devices of smaller size can be readily made. These advantages make the applicant's device easier to use and generally more dependable and safer than previous devices.

The present invention overcomes the breakage and "walking" problems of the prior art by providing a significant flexible length of both the main supporting member and the cam actuating mechanism between the cam actuator and the manually engageable means.

The coaxial nature of the actuating sleeve and the main support cable in present the invention also allows some temporary control of the relative stiffness of the main body of the device when it is being placed. Once the cams of the present device are fully retracted the tension on the actuating sleeve can be increased by simply squeezing harder with the thumb and fingers being used. The increased tension has the effect of causing the sleeve to become more rigid. This provides better control of the position of the camming members which can make a difficult placement easier to accomplish but does not require that the main support cable and the sleeve be made permanently more rigid.

The present invention provides for effective operation of the camming head by application of a force parallel to the main cable axis to each of the several camming members which forces are essentially symmetrical about the main axis of the device but which are applied at a distance from the axis.

By enclosing a substantial portion of the main support cable of the present invention within an actuating sleeve, the sleeve provides a protective cover for the main support cable to help prevent damage to the cable as the result of cutting or abrasion in normal use, thereby lengthening the useful life of the device and making it safer in normal use.

A climber will typically carry numerous anchors for use in varying placements or different sizes of cracks. While paused to place an anchor, he may be maintaning his position with a bare minimum of handholds or footholds and supporting himself may be quite strenuous and fatiguing. Furthermore he must have at least one hand free in order to be able to place an anchor for protection. Under these circumstances the amount of time required to choose and place an anchor can be crucial to the safety of the climber and the success of the climb. By using varying colors of tubing on various sizes of devices, each color corresponding to a device size for use in cracks of a particular range of widths, a climber who may be perched precariously on a rock wall can readily identify one size of device of the many which he may be carrying which is most suitable for the anchor placement being attempted and thus save time and energy in accomplishing such placement.

DESCRIPTION OF THE PREFERRED EMBODIMENT

Figure 1:
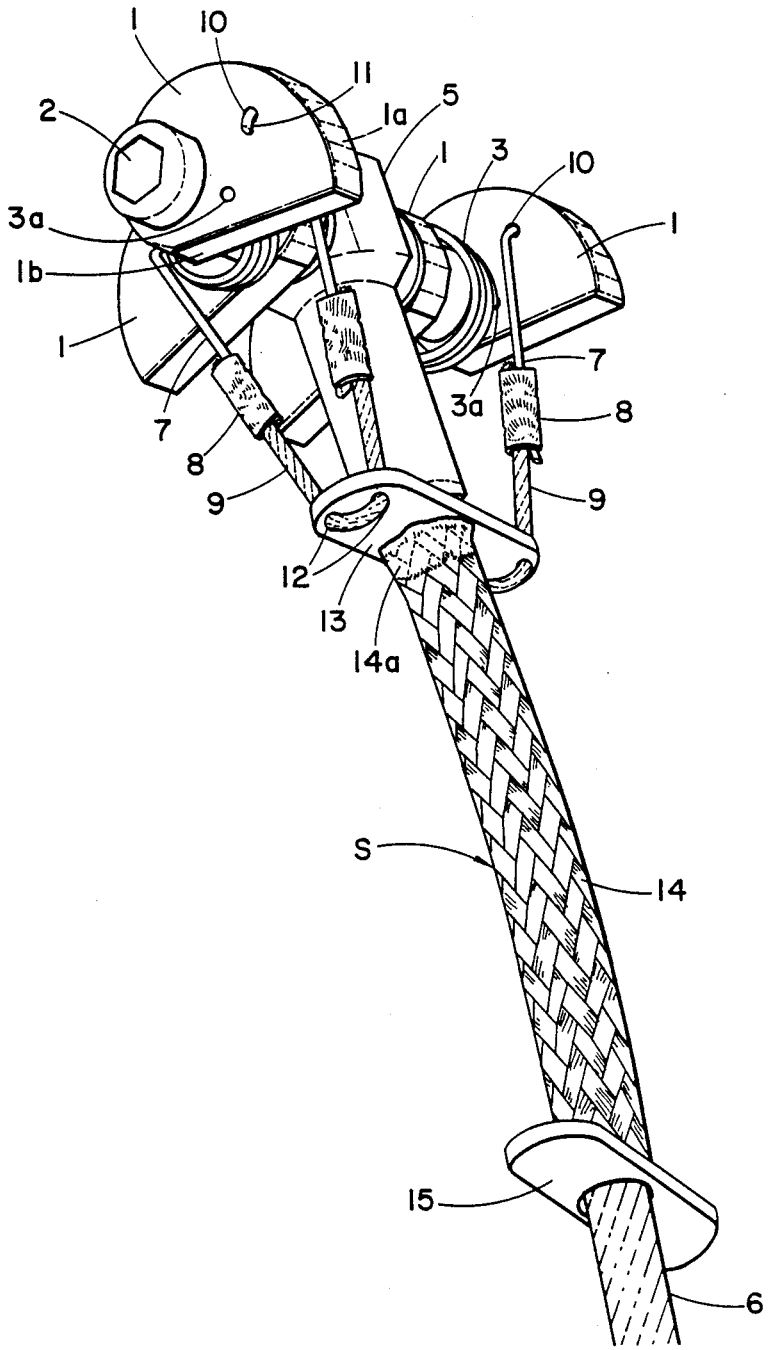
FIG. 1 is a perspective view of the head and actuating sleeve of the preferred embodiment of an anchoring device according to this invention.
Figure 2:
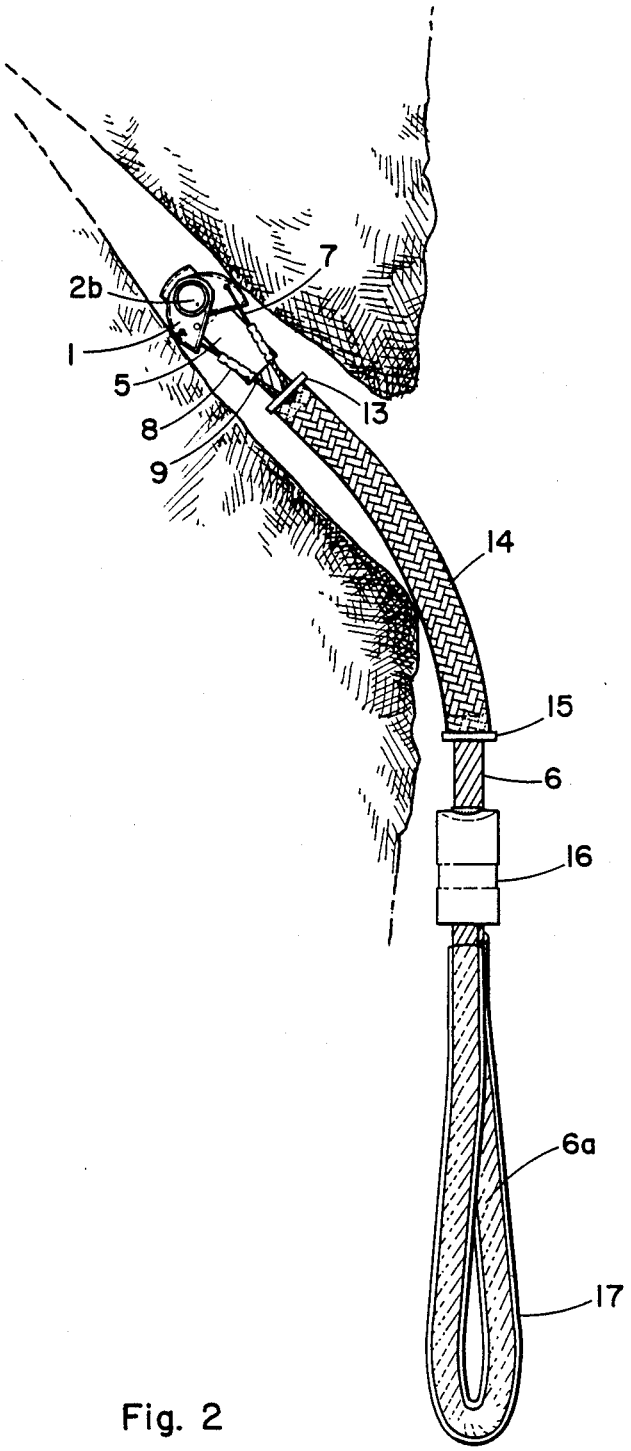
FIG. 2 is a cutaway view of a crevice in a rock face at approximately 45 degrees from horizontal with the anchoring device as it could be placed in such a crevice.
Figure 3:
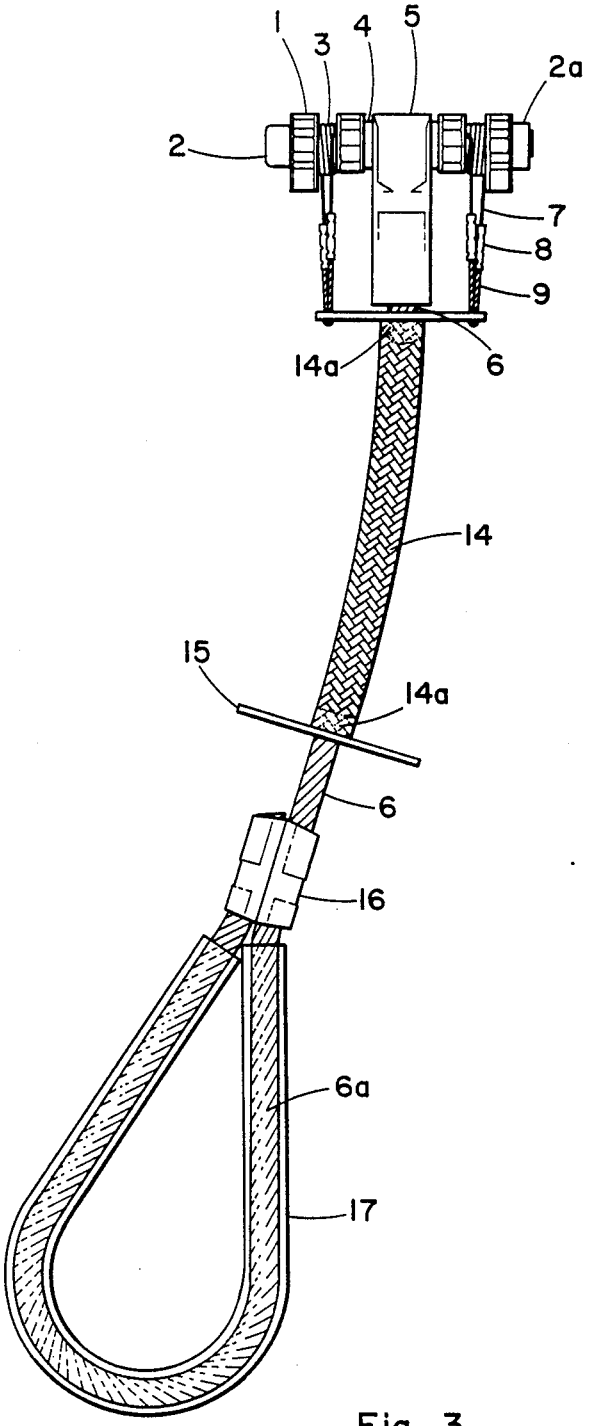
FIG. 3 is a plan view of the anchoring device perpendicular to the axis about which the camming members pivot.

According to the present invention the anchoring device in FIG. 1 may comprise a camming means in the form of a multiple-cam anchoring head having four camming members 1 mounted in two pairs which pivot on a main axle 2. Each camming member is generally shaped with a curved multi-faceted rock engaging face 1*a* which has an increasing radius as measured from the pivot axis of the camming member on the axle and a face 1*b* extending generally perpendicular to the facet on face 1*a* at the largest radius. Each of the several camming members is identical in size and shape for any single device. Although each device can be used as an anchor in cracks with widths over a selected range, the size of the camming members may be varied from one device to another to allow different devices to serve as anchors in varying ranges of crack sizes which may be encountered while climbing. The camming members 1 are machined from 6061 T6 aluminum alloy which is desirable because of its relatively light weight and malleability. This malleability aids in the grip of the cam members when in place against a rock surface by allowing a very slight conformance of the surface of the cam members to the surface of the rock. These members could be made of any solid material of sufficient strength which would not deform significantly under the pressure created on the surface of the member by the camming action resulting from the load bearing of the device. The axle 2 is a grade 8 chrome-moly steel alloy screw having a socket head at one end and secured at the opposite end by a round threaded nut as shown in FIG. 3 at 2*a*. The end of the axle is preferably staked, peened or otherwise deformed as seen at 2*b* in FIG. 2 after the nut is in place so as to fix the nut permanently. Each pair of camming member is spring-biased toward its open position by means of the force of a spring 3 coiled around the axle between the members and having ends which are bent parallel to the axle axis and received into holes 3*a* parallel to the axle in each of the two adjacent camming members of the pair on either side of the head securing member 5 through which axle 2 extends transversely. Each pair of camming members is separated from the head securing member 5 by a circular washer 4 which is positioned on the axle to minimize frictional interference between the head securing member 5 and the adjacent camming member on either side. Each camming member is actuated by a length of thin but rigid wire 7 which is bent approximately perpendiclar to its length to pass through a hole 10 in the camming member and which is free to pivot within the hole. The free end of the wire is further bent approximately perpendicular to the section of wire which passes through the hole 10 so as to prevent the wire from slipping out of said hole. The opposite ends of the rigid wires 7 from each pair of two adjacent camming members are crimpted with a malleable connector 8 to opposite ends of a flexible cable 9 which is attached to the cam actuating plate 13 by looping through two holes 12 at one end of the plate. The plate 13 forms one end of an elongated slidable flexible sleevelike assembly structure S consisting of plate 13, braided flexible metallic sleeve member 14 and manually engageable plate 15 forming the other end of the structure. "When the plate 15 is pulled, the pulling force and motion is transmitted through the sleeve member 14 to the plate 13, at the other end of the structure S, whic is connected to thereby actuate the cam members against their biasing springs." The cam actuating plate also abuts the head securing member when the camming assembly is in the open position creating a stop for preventing the camming members from opening past the point of the maximum usable width of the camming means. The faces 1*b* of the cam members are never permitted to become coplanar when the cams move to the open position.

The head securing member 5 is generally elongated and is bored therethrough near one end thereof and perpendicular to its longer dimension so as to receive the axle 2 with a tight fit. The opposite end is axially bored so as to receive the end of the flexible main support cable 6 which is inserted into the bored recess and is permanently secured therein. The head securing member 5 and the cable 6 can be made of stainless steel and secured together by silver brazing. If a torch is used to accomplish the brazing, heat is applied to the head securing member and care is taken to avoid applying the open flame directly to the cable so as to avoid causing any embrittlement or weakening of the cable. Alternatively, and particularly where a stronger supporting cable is desirable, the head securing member can be made from a strong but malleable metal such as copper and fixed to the cable end by swaging in substitution of the brazing process. This allows use of stronger galvanized aircraft cable which would be weakened by the heat of brazing. The result is that a cable of smaller diameter than would be required in stainless steel may be used to achieve the same strength. The main support cable must be of a sufficient strength to support any force to which it may be subjected, such as that resulting from stoppping the fall of a climber.

The cam actuating plate 13 may be constructed of stainless steel and forms one end of the cam actuating sleeve structure, the opposite end being formed of a manually engageable plate 15. A hole of a diameter slightly larger than the diameter of the main support cable is drilled through the center of each of these plates to allow the main supporting cable to pass through and slide freely within these holes but so as to minimize the any excessive play transverse to the cable axis between cable and plate. Each plate is elongated and the plates are oriented generally parallel to each other and to the axle axis so that the sleeve assembly structure may lie essentially flat against a rock surface such as the crevice wall with the longer sides of the plates abutting the surface. The length of plate 13 is also such that holes 12 therein properly position the wires 7 and cables 9 to avoid interference with movement of the cams.

Connecting end plates 13 and 15 is the braided flexible stainless steel sleeve 14 which is coaxial with the main support cable 6 and which encases and slides axially on a portion of the support cable. Each end of the sleeve is brazed to one of the plates in a manner such that the inner circumference of each end of the sleeve mates closely with the circumference of the center hole of the corresponding end plate 14*a*. The inner diameter of the sleeve, which varies as stretching and compressing forces are applied axially along the sleeve, must be at its minimum slightly larger than the outer diameter of the main support cable so as to allow the sleeve to slide freely upon the cable when the sleeve is in tension. This sleeve provides a means of extending the distance from the camming members to the point at which human fingers can be used to operate the camming members without sacrificing the flexibility of the main support cable. The sleeve assembly could also be constructed of a single piece of molded flexible plastic or of any suitable tubular material with a minimum inside diameter again only slightly larger than the outside diameter of the cable and with elongated end pieces adhered in any suitable manner to accomplish the purpose of the invention.

The end of the main support cable 6 opposite the point of attachment of the camming head is looped back approximately 180 degrees and connected with swaged connector 16 to a point on the cable so as to form a loop 6a to which a climbing rope may be attached, most commonly by using a carabiner or other similar device. The space between the plate 15 and the swaged connector 16 is the only area where the exterior surface of the cable 6 is exposed to possible abrasion or other similar abuse. The length of this space is kept to the minimum necessary to permit sliding of the sleeve structure S on the cable between the positions corresponding to open and fully retracted positions of the cams. Even in this space the cable 6 is at least partially protected by the larger dimensions of the adjacent plate 15 and connector 16. The loop 6a forms the means for engaging a human thumb so as to permit operation of the camming head by the opposing motion of the thumb and fingers with the fingers straddling the sleeve and main support cable and engaging the plate 15. The loop of cable is covered with a length of flexible tubing 17 made of a transparent plastic such as PVC or other suitable material. This cable cover provides a softer smoother surface which is more comfortable against the thumb of the climber who is operating the device and which provides further protection of this portion of the cable against damage from abrasion. Such cable cover is preferably transparent so as to allow determination of the condition of the covered portion of the main support cable by visual inspection and may also be transparently tinted in a color to correspond to the size of the particular device so as to allow a climber to readily identify a device size by color code while climbing.

The anchoring device is readily manually actuated with one hand by means of the sliding structure S by engaging and pulling on the plate 15 with two fingers and by pushing with the thumb in loop 6a. This actuation applies an axial tension force to the flexible sleeve 14 and an axial compressive force to the cable. This actuation causes the camming members to retract from their open position by pivoting on the axle 2 and effectively decreases the width of the camming head in a direction perpendicular to both the axle 2 and the main support cable 6. The anchoring head with retracted cams can then be inserted into a crevice. Upon release of the actuating force the cams 1 are urged by the springs 3 into contact with the walls of the crevice. When given a firm manual tug on the loop 6a the device assumes the position shown, for example, in FIG. 2 with the faceted faces 1a of the cams wedged by their camming action into secure engagement with the crevice walls. The anchoring head is typically inserted into the crevice to an extent which makes plate 13 manually inaccessible, yet easily actuated by manually engaging plate 15 which is at the opposite end of sleeve 14 but which can be located well outside the crevice due to the length of the sleeve.

For a typical anchoring device according to this invention which is to be used in cracks varying from $\frac{3}{8}$ to $\frac{1}{2}$ inch in width, normally referred to as a $\frac{3}{8}$ inch camming device , the various components as described above may have the following dimensions (in units used when available commercially):

Maximum extended (open) width across cams, 13 mm.
Minimum retracted width across cams, 8.5 mm.
Length of securing head 5, 1 inch
Sleeve 14 length, 2.5 inches
Sleeve 14 O.D., $\frac{1}{4}$ inch
Sleeve 14 I.D., 3/16 inch
Cable 6 O.D., 5/32 inch
Plates 13 and 15 thickness, 1/16 inch
Tubing 17 O.D., 5/16 inch
Tubing 17 I.D., 3/16 inch
Wire 7 diameter, 0.031 inches
Cable 9 diameter, 0.032 inches Other larger camming devices for the following nominal sizes may have open and retracted widths of the cams as follows:

| Nominal size | Open Width | Retracted Width |
|---|---|---|
| $\frac{1}{2}$ inch | 19 mm. | 12 mm. |
| $\frac{3}{4}$ inch | 22 mm. | 15 mm. |
| $1\frac{1}{4}$ inches | 33 mm. | 20 mm. |

These width dimensions indicate that the size ranges overlap so that a set of these devices completely covers a wide range of crack sizes. The dimensions of the sleeve 14 and the diameter of cable 6 may remain the same for the four different sizes of devices listed above. However the length of the sleeve 14 and cable 6 may be increased significantly as desired preferably keeping the space between the plate 25 and the connector 16 to the necessary minimum previously described. Other listed dimensions may change as obviously necessary when the sizes of the cams 1 increase.

Other variations within the scope of this invention will be apparent from the described embodiment and it is intended that the present descriptions be illustrative of the inventive features encompassed by the appended claims.

What is claimed is:

1. An anchoring device on the end of a flexible main cable for insertion into a space between two walls and having spring-biased camming means which wedges by a camming action into engagement with said walls upon application of tension to the cable, the camming means being actuated against the spring bias by means including an elongated flexible sleevelike structure coaxially supported on the cable, the structure having at one end thereof means secured to the sleevelike structure and interconnecting the structure with the camming means for pulling the camming means against the spring bias, the sleevelike structure having secured thereto at its other end manually engageable means to apply tension to the structure at said other end and therefrom through the structure axially along the main cable to pull the sleevelike structure and the interconnecting means in the direction away from the camming means to actuate the camming means against the spring bias, the length of the sleevelike structure being sufficient to permit the camming means and the interconnecting means to be inserted deeply into the space where the interconnecting means cannot be directly manipulated, the cable having manually engageable means on a portion thereof extending away from said structure to apply an axial compression force to the cable while tension is being applied to the structure to permit insertion of the device into the space between said walls and to release the device from said walls, the flexible coaxial main cable and sleevelike structure allowing movement after placement of the device in an anchoring position of the manually engageable means on said structure and the portion of the cable extending away from the flexible structure without causing movement of the camming means from a wedged position.

2. An anchoring device according to claim 1 wherein said sleevelike structure is an elongated flexible braid.

3. An anchoring device according to claim 1 wherein said sleevelike structure is a flexible metal braid having a minimum inside diameter when under tension which permits it to slide freely on said cable.

4. A climbing device on the end of a flexible main cable for insertion into a crevice in a rock wall and having camming means which wedges by a camming action into engagement with the side walls of the crevice upon application of tension to the cable, said camming means having means biasing the camming means toward a wedging position, said camming means being actuated against the bias by means including an elongated flexible sleevelike structure coaxially supported on the cable, the structure having at one end thereof a first means secured to the sleevelike structure and interconnecting the structure with the camming means for pulling the camming means against the biasing means, the sleevelike structure having secured thereto at its other end means engageable by fingers of the climber on opposite sides of the sleevelike structure to apply a force to said other end to pull the structure axially along the main cable in the direction away from the camming means and transmit the pulling force through the sleevelike structure to the interconnecting means to actuate the camming means against the biasing means, the length of the sleevelike structure being sufficient to permit the camming and the interconnecting means to be inserted deeply into the crevice where the interconnecting means cannot be directly manipulated, the cable having manually engageable means thereon to apply compression axially to said cable while said structure is being pulled to permit insertion of the device into the crevice and to release the device from the crevice, the flexible coaxial main cable and sleevelike structure allowing movement after placement of the device in an anchoring position of both the finger-engageable means on said other end of the structure and the portion of the cable extending beyond said structure at that other end without causing movement of the camming means from a wedged position.

5. A device according to claim 1 or 4 wherein said sleevelike structure comprises an elongated sleeve member and said interconnecting means comprises a plate secured to said sleeve member at said one end of the sleevelike structure.

6. A device according to claim 5 wherein said sleeve member is a flexible metal braid havingt a minimum inside diameter when under tension which permits it to slide freely on said cable.

7. A device according to claim 6 wherein the portion of the cable extending away from the flexible structure is primarily a loop and said device includes means for protecting essentially the entire cable from abrasion.

8. An anchoring device according to claim 4 wherein said sleevelike structure is an elongated flexible braid.

9. An anchoring device according to claim 4 wherein said sleevelike structure is a flexible metal braid having a minimum inside diameter when under tension which permits it to slide freely on said cable.

10. A climbing device on the end of a flexible main cable for insertion into a crevice in a rock wall and having spring-biased wedging means which wedges by a mechanical action into engagement with the side walls of the crevice upon application of tension to the cable, the wedging means being biased to an open or wedging position and actuated against the spring bias by means including an elongated flexible sleevelike structure coaxially supported on the cable, the structure having at one end thereof means secured to the sleevelike structure and interconnecting the sleevelike structure with the wedging means for operating the wedging means against the spring bias, the sleevelike structure having secured thereto at its other end a plate engageable by fingers of the climber on opposite sides of the sleevelike structure to apply a force to said other end to pull the structure along the main cable in the direction away from the wedging means and transmit the pulling force through the sleevelike structure to the interconnecting means to actuate the wedging means against the spring bias, the length of the structure being sufficient to permit the wedging means and the interconnecting means to be inserted deeply into the crevice where the interconnecting means cannot be directly manipulated, the cable having means thereon engageable by the thumb of the climber to permit one-hand insertion of the device into the crevice and to release the device from the crevice by pushing the thumb toward the wedging means and pulling the structure by two fingers engaging the plate, the flexible coaxial main cable and sleevelike structure allowing movement after placement of the device in an anchoring position of the plate and the portion of the cable extending away from the structure without causing movement of the wedging means from a wedged position.

11. A climbing device according to claim 10 wherein said wedging means comprises multiple pivoted cams for engaging the walls of the crevice, said interconnecting means including a plate secured to said structure and small flexible members interconnecting said plate with said cams.

12. A climbing device according to claim 11 wherein said flexible members are located essentially symmetrically about the axis of the cable.

13. A climbing device according to claim 12 wherein said sleevelike structure comprises a flexible metal braid to provide flexibility along essentially its entire length.

14. A climbing device according to claim 10 wherein the thumb-engageable means is a loop in the cable.

15. A device according to claim 14 wherein essentially all of said loop is covered with a flexible transparent plastic to protect the loop from abrasion and to permit inspection of the cable in the loop.

16. A device according to claim 15 wherein said transparent plastic is colored to indicate the size of the device.

17. An anchoring device according to claim 10 wherein said sleevelike structure is an elongated flexible braid.

18. An climbing device according to claim 10 wherein said sleevelike structure is a flexible metal braid having a minimum inside diameter when under tension which permits it to slide freely on said cable.

* * * * *